United States Patent [19]

Peterson

[11] Patent Number: 4,742,755

[45] Date of Patent: May 10, 1988

[54] HEATING ATTACHMENT FOR A MUSICAL INSTRUMENT

[76] Inventor: Frederick D. Peterson, 91 Ennis Rd., North Oxford, Mass. 01537

[21] Appl. No.: 29,633

[22] Filed: Mar. 24, 1987

[51] Int. Cl.[4] ..... G10G 5/00

[52] U.S. Cl. ..... 84/453; 84/387 R; 84/398; 219/201; 219/385; 219/521

[58] Field of Search ..... 84/387, 398, 453; 219/200, 201, 385, 386, 521

[56] References Cited

U.S. PATENT DOCUMENTS 4,700,606 10/1987 Tayama ..... 84/453 X

FOREIGN PATENT DOCUMENTS 197330 10/1907 Fed. Rep. of Germany ..... 84/387

*Primary Examiner*—Michael L. Gellner
*Assistant Examiner*—Brian W. Brown
*Attorney, Agent, or Firm*—Norman S. Blodgett; Gerry A. Blodgett

[57] ABSTRACT

A heating attachment for the mouthpiece of a musical wind instrument for heating the mouthpiece during outdoor playing of the instrument in cold weather. The attachment includes a sleeve which is adapted to be mounted on the mouthpiece and which includes an electrical heating element. The attachment also includes a source of electrical power and a switch for selectively connecting the heating element to the source of electrical power.

6 Claims, 2 Drawing Sheets

FIG. 1
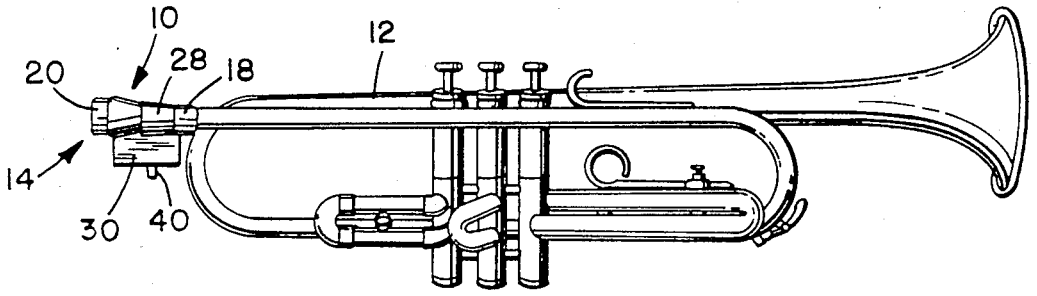
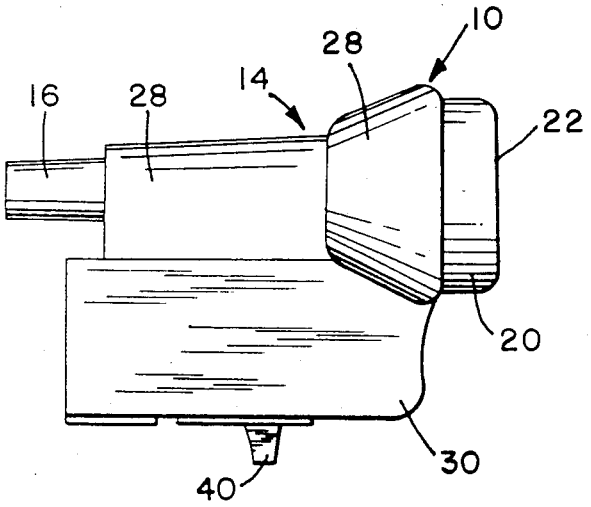
FIG. 3
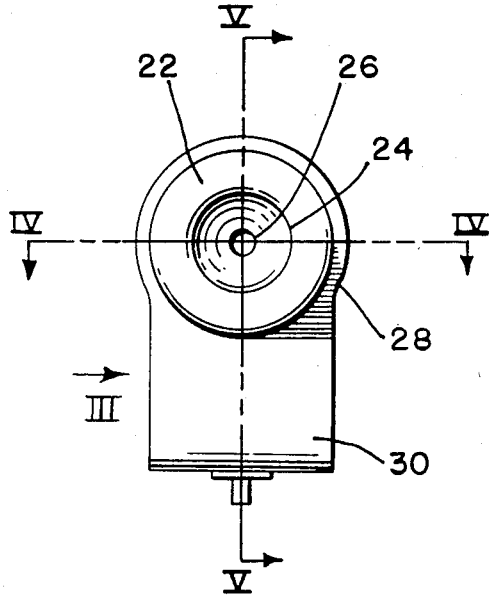
FIG. 2

FIG. 4
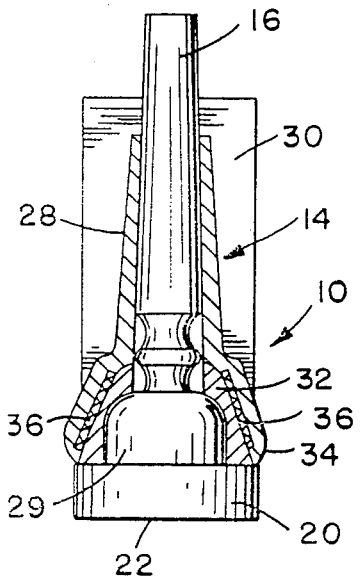
FIG. 5
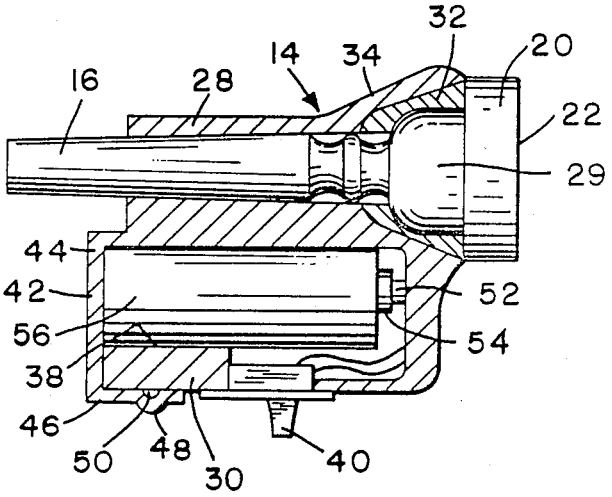
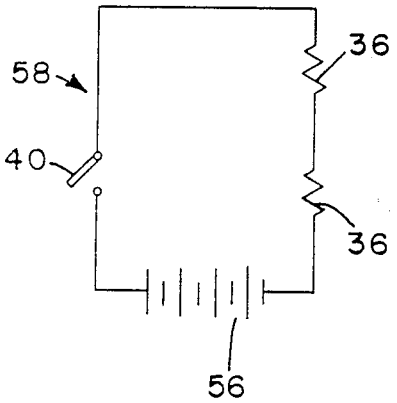
FIG. 6

HEATING ATTACHMENT FOR A MUSICAL INSTRUMENT

BACKGROUND OF THE INVENTION

This invention relates generally to a heating attachment for a musical instrument of the wind type which is sounded by a player's breath. The invention is particularly directed to a wind instrument of the so-called "brass instrument" type which is frequently played out of doors such as a bugle, trumpet or a cornet.

When a brass musical instrument is played out of doors in sub-freezing temperature, the player experiences considerable difficulty. When the temperature of the ambient air is cold, the entire instrument becomes cold, including the mouthpiece of the instrument. When the player presses his or his lips against the mouthpiece of the instrument, he or she experiences substantial physical discomfort. Initially, the discomfort is in the form of pain and then numbness which seriously reduces the player's ability to play the instrument. Since the manipulation of the lips forms an important part in the playing of brass instruments, the numbing effect of the cold on the lips becomes a critical factor in playing the instrument. Plastic mouthpieces have been used for outdoor playing in an attempt to increase the comfort factor on the player's lips. However, plastic does not resonate as well as metal and, is therefore not as desirable as metal. In addition, even the plastic mouthpiece can become uncomfortable for the player's lips when the air is cold enough. These and other difficulties experienced with the playing of musical wind instruments for outdoor use in cold weather have been obviated by the present invention.

It is, therefore, a principle object of the invention to provide a heating attachment which will maintain the mouthpiece of a wind instrument above the temperature of the ambient air to enable the instrument to be played outdoors when the air is cold.

Another object of this invention is the provision of a heating attachment for a musical wind instrument which utilizes a battery as a power source and is thereby totally portable.

A further object of the present invention is the provision of a heating attachment for a musical wind instrument which is capable of being selectively activated for heating.

It is another object of thpresent invention to provide a heating attachment for a musical wind instrument which is capable of heating the mouthpiece of the instrument sufficiently so as to prevent the player's lips from being affected by the cold when playing out of doors under cold weather conditions.

A still further object of the invention is the provision of a heating attachment for a wind musical instrument for cold weather playing which is relatively inexpensive and easy to use.

It is a further object of the invention to provide a heating attachment for a musical wind instrument which is easy to attach and detach from the mouthpiece of the musical instrument.

With these and other objects in view, as will be apparent to those skilled in the art, the invention resides in the combination of parts set forth in the specification and covered by the claims appended hereto.

SUMMARY OF THE INVENTION

In general, the invention consists of a heating attachment for a musical instrument of the wind type which includes a mouthpiece. The attachment comprises a housing having a sleeve portion which is adapted to be removably mounted on the mouthpiece, an electrical heating element in the sleeve portion, a source of electrical power in the housing and electrical circuitry, including a switch for selectively connecting the electrical heating element to the source of electrical power. More specifically, the electrical element is a thermistor and the source of electrical power is a DC battery. The thermistor is located between heat conductive material on the inside and heat insulating material on the outside.

BRIEF DESCRIPTION OF THE DRAWINGS

The character of the invention, however, may be best understood by reference to one of its structural forms, as illustrated by the accompanying drawings, in which:

FIG. 1 is a side elevational view of the attachment embodying the principles of the present invention shown attached to a trumpet, FIG. 2 is a front elevational view of the attachment of FIG. 1 shown attached to the mouthpiece of the trumpet, FIG. 3 is a side elevational view of the attachment looking in the direction of arrow three of FIG. 2, FIG. 4 is a horizontal sectional view of the attachment taken along the line IV—IV of FIG. 2, FIG. 5 is a vertical sectional view of the attachment taken along the line V—V of FIG. 2, and FIG. 6 is an electrial schematic for the attachment of the present invention.

DESCRIPTION OF THE PREFERRED EMBODIMENT

Referring first to FIGS. 1, 2, and 3, the heating attachment of the present invention is generally indicated by the reference numeral 10 and is shown attached to the mouthpiece 14 of a trumpet 12. The trumpet 12 represents one of several wind-type "brass" musical instrument for which the present invention is specifically adapted. The heating attachment 10 of the present invention can also be used with a bugle, french horn, clarinet, or cornet. The mouthpiece 14 includes a tubular tapered inner portion 16 which is adapted to be slidingly inserted within a tubular portion 18 of the trumpet and which enables the mouthpiece to be removably attached to the trumpet. The mouthpiece 14 also includes an outer head portion 20 which has an outer surface 22 which is adapted to be engaged by the lips of the player. The outer surface 22 has a circular recess 24 which makes the outer portion of the surface 22 circular in shape. A bore 26 is concentric with the circular recess 24 and extends from the recess all the way through the tubular inner portion 16.

Referring also to FIGS. 4 and 5, the attachment 10 comprises a housing which includes a generally circular sleeve portion 28 and a battery casing 30. The sleeve portion 28 is adapted to fit closely about a bulbous portion 29 of the mouthpiece as shown in the drawings. The sleeve portion 28 includes an annular inner layer 32 and an annular outer layer 34 which is generally concentric with the inner layer 32. A pair of diametrically opposed thermistors 36 are located between the inner and outer portions 32 and 34, respectively. The inner layer 32 is made of a heat conductive material such as metal and the outer layer 34 is made of a heat insulating material such as plastic, leather or rubber. In the preferred form of the invention the outer layer is made of an elastomeric material which insures a snug fit of the sleeve on the mouthpiece, particularly at the narrow end of the sleeve where the outer layer 34 engages the mouthpiece.

The battery casing 30 includes a battery compartment 38 and a switch 40. The inner end of the compartment 38 is opened and closed by a closure cap 42. The cap 42 is integral with the sleeve portion 28 and the battery casing 30 and is made out of a flexible material such as rubber, leather or soft plastic which enables the cap 42 to be hinged relative to the battery case 30 at the junction point 44. The cap 42 also includes a flap 46 which overlaps one side of the battery case 31 as shown in FIG. 5. The flap 46 includes a snap fastener element 48 which is adapted to engage a complimentary snap fastener element 50 on the outside surface of the batter case 31. The cap 42 also contains a pair of contact elements 52 which are adapted to engage complimentary terminal connections 54 of a standard 9 volt battery 56 when the battery is located within the battery compartment 38 as shown in FIG. 5. The contact elements 52 are wired to the switch 40 and to the thermistors 36 for selectively connecting the thermistors to the battery 56. The wiring circuitry is shown in FIG. 6 and is generally indicated by the reference numeral 58.

The operation and advantages of the present invention will now be readily understood in view of the above description. When a wind instrument such as the trumpet 12 is played in cold weather, the heating attachment 10 is applied to the instrument by first removing the mouthpiece 14 from the instrument. The sleeve portion 28 of the attachment is slipped over the tubular inner portion 16 of the mouthpiece until it covers the bulbous portion 29 of the mouthpiece as shown in FIG. 3. The tubular inner portion 16 is then reinserted into the tubular end portion 18 of the trumpet and the switch 40 is moved to the closed position to operatively connect the battery 56 within the compartment 38 to the thermistors 36. As the thermistors become heated, heat is transferred to the mouthpiece 14 and the player is then able to play the instrument with comfort to his or her lips. If desired, the player can move the switch 40 to the open position during periods of extended non-playing to conserve on energy from the battery. The battery can be replaced by unsnapping the flap 46 and pivoting the cap 42. This exposes the inner opening of the battery case for removal of the battery and insertion of a new battery. The terminal connections 54 of the new battery are attached to the contact elements 52 and the snap fastener 48 of the flap 46 is reconnected to the snap fastener 50 of the battery case. Excellent results have been obtained by using two 16 ohm at 25° celcius thermistors with a 9 volt battery. This combination is capable of heating the mouthpiece approximately 14° C. or 25° F. For example, from 25° F. to 50° F. or from 3.9° centigrade to 10° centigrade.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A heating attachment for a musical insrument of the wind type which is sounded by a player's breath and which includes a mouthpiece which has an apertured end surface which is adapted to be engaged by the player's lips, said heating adapter comprising:

(a) a housing which includes a sleeve portion which is adapted to be removably mounted on the mouthpiece of the musical instrument so that the apertured end surface of said mouthpiece is exposed, (b) at least one electrical heating element within said sleeve portion, (c) a source of electrical power which is located within said housing, and (d) electrical circuitry including a switch for selectively connecting said electrical heating element to said source of electrical power.

2. A heating attachment as recited in claim 1, wherein said housing includes a battery compartment and said source of electrical power consists of a battery within said compartment.

3. A heating adapter as recited in claim 1, wherein said electrical heating element is a thermistor.

4. A heating attachment as recited in claim 3, wherein there is a pair of thermistors which are diametrically opposed within said sleeve portion.

5. A heating attachment as recited in claim 1, wherein said sleeve portion comprises an inner layer of heat conductive material which is adapted to engage said mouthpiece and an outer layer of heat insulating material, and wherein said electrical heating element is located between said inner and outer layers.

6. A heating attachment as recited in claim 1, wherein said electrical heating element is a 16 ohm thermistor and said source of electrical power is a 9 volt DC battery.

* * * * *